US009347411B2

(12) United States Patent
Friedrich et al.

(10) Patent No.: US 9,347,411 B2
(45) Date of Patent: May 24, 2016

(54) DECOUPLING ELEMENT FOR A FUEL INJECTION DEVICE

(71) Applicant: ROBERT BOSCH GMBH, Stuttgart (DE)

(72) Inventors: Markus Friedrich, Moosburg (DE); Martin Scheffel, Vaihingen (DE); Martin Buehner, Backnang (DE)

(73) Assignee: ROBERT BOSCH GMBH, Stuttgart (DE)

( * ) Notice: Subject to any disclaimer, the term of this patent is extended or adjusted under 35 U.S.C. 154(b) by 7 days.

(21) Appl. No.: 14/365,005

(22) PCT Filed: Nov. 12, 2012

(86) PCT No.: PCT/EP2012/072369

§ 371 (c)(1),
(2) Date: Jun. 12, 2014

(87) PCT Pub. No.: WO2013/092003

PCT Pub. Date: Jun. 27, 2013

(65) Prior Publication Data

US 2015/0013644 A1 Jan. 15, 2015

(30) Foreign Application Priority Data

Dec. 20, 2011 (DE) ..... 10 2011 089 295

(51) Int. Cl.
*F02M 59/48* (2006.01)
*F02M 55/00* (2006.01)
*F02M 61/14* (2006.01)

(52) U.S. Cl.
CPC ..... *F02M 59/48* (2013.01); *F02M 55/004* (2013.01); *F02M 61/14* (2013.01); *F02M 2200/09* (2013.01)

(58) Field of Classification Search
CPC ..... F02M 61/14; F02M 2200/856; F02M 2200/858; F02M 2200/852; F02M 55/004; F02M 61/168; F02M 2200/85
USPC ..... 123/470, 294, 456, 445, 193.3; 239/533.2, 533.9; 137/315.11, 315.31, 137/316
See application file for complete search history.

(56) References Cited

U.S. PATENT DOCUMENTS 5,967,121 A * 10/1999 Pirch et al. ..... 123/470
6,009,856 A 1/2000 Smith, III et al.

(Continued)

FOREIGN PATENT DOCUMENTS

DE 100 27 662 12/2001
DE 100 38 763 2/2002

(Continued)

OTHER PUBLICATIONS

International Search Report, PCT International Application No. PCT/EP2012/072369, dated Jan. 18, 2013.

*Primary Examiner* — Stephen K Cronin
*Assistant Examiner* — Long T Tran
(74) *Attorney, Agent, or Firm* — Norton Rose Fulbright US LLP

(57) ABSTRACT

A decoupling element for a fuel injection device has a low-noise construction. The fuel injection device includes at least one fuel injector and one receiving bore in a cylinder head for the fuel injector and the decoupling element between a valve housing of the fuel injector and a wall of the receiving bore. The decoupling element has a nonlinear progressive spring characteristic as a solid-state joint, at least one bearing collar including a valve contact surface, which is designed to be spherical, i.e., convex, extending upward from a flat annular area, the flat annular area being supported on a supporting base, and the inside of the annular area has a smaller inside diameter D than the bearing collar and the supporting base, which is supported on the wall of the receiving bore.

11 Claims, 5 Drawing Sheets

(56) References Cited

U.S. PATENT DOCUMENTS

| | | | | |
|---|---|---|---|---|
| 6,578,554 | B2 | 6/2003 | Schroeer | |
| 6,718,949 | B2 * | 4/2004 | Gmelin | 123/470 |
| 6,807,945 | B2 | 10/2004 | Reiter et al. | |
| 6,811,102 | B2 | 11/2004 | Krause et al. | |
| 6,899,087 | B2 | 5/2005 | Norgauer | |
| 7,261,246 | B2 | 8/2007 | Krause et al. | |
| 7,765,984 | B2 * | 8/2010 | Fuerst et al. | 123/456 |
| 7,918,209 | B2 * | 4/2011 | Fischetti et al. | 123/470 |
| 8,069,842 | B2 * | 12/2011 | Kannan | 123/470 |
| 2007/0228662 | A1 * | 10/2007 | Reiter et al. | 277/313 |
| 2008/0264390 | A1 * | 10/2008 | Rottenwohrer et al. | 123/470 |
| 2009/0050113 | A1 * | 2/2009 | Liskow | 123/470 |
| 2009/0071445 | A1 * | 3/2009 | Mueller et al. | 123/470 |
| 2009/0173317 | A1 * | 7/2009 | Doherty et al. | 123/470 |
| 2009/0235898 | A1 * | 9/2009 | Short | 123/470 |
| 2009/0235899 | A1 * | 9/2009 | Biasci et al. | 123/470 |
| 2010/0175667 | A1 | 7/2010 | Chern et al. | |
| 2010/0175668 | A1 | 7/2010 | Chern et al. | |
| 2010/0192913 | A1 * | 8/2010 | Keidel et al. | 123/470 |
| 2011/0000464 | A1 | 1/2011 | Kannan et al. | |

FOREIGN PATENT DOCUMENTS

| | | |
|---|---|---|
| DE | 101 08 466 | 9/2002 |
| EP | 1 223 337 | 7/2002 |
| JP | 2010127193 A | 6/2010 |

* cited by examiner

DECOUPLING ELEMENT FOR A FUEL INJECTION DEVICE

FIELD

The present invention is directed to a decoupling element for a fuel injection device according to the definition of the species in the main claim.

BACKGROUND INFORMATION

A flat intermediate element may be provided on a fuel injector installed in a receiving bore in a cylinder head of an internal combustion engine. Such intermediate elements as supporting elements in the form of a washer are placed on a shoulder of the receiving bore of the cylinder head in a conventional way. With the help of such intermediate elements, manufacturing tolerances and assembly tolerances are compensated and a bearing support free of transverse forces is ensured even when the fuel injector is in a slightly skewed position. The fuel injection device is suitable for use in fuel injection systems in mixture-compressing, spark-ignition internal combustion engines in particular.

Another type of simple intermediate element for a fuel injection device is described in German Patent No. DE 101 08 466 A1. This intermediate element is a washer having a circular cross section and is situated an area where both the fuel injector and the wall of the receiving bore have a truncated conical shape in the cylinder head, and the washer acts as an equalizing element for bearing and support of the fuel injector.

More complex intermediate elements for fuel injection devices, which are more complicated to manufacture, are described in German Patent Application Nos. DE 100 27 662 A1, and DE 100 38 763 A1 and European Patent No. EP 1 223 337 A1, among others. These intermediate elements are characterized in that they are all constructed in multiple layers or multiple parts and should undertake sealing and damping functions to some extent. The intermediate element described in German Patent Application No. DE 100 27 662 A1 has a base body and a carrier body, in which a sealant through which a nozzle body of the fuel injector passes is used. German Patent Application No. DE 100 38 763 A1 describes a multilayer equalizing element made up of two rigid rings and an elastic intermediate ring sandwiched in between. This equalizing element permits tilting of the fuel injector relative to the axis of the receiving bore over a relatively large angle range as well as radial displacement of the fuel injector from the central axis of the receiving bore.

European Patent No. EP 1 223 337 A1 also describes a multilayer intermediate element composed of multiple washers, each made of a damping material. The damping material made of metal, rubber or PTFE is selected and designed in such a way that it enables damping of the vibrations and noises generated by operation of the fuel injector. However, the intermediate element must have four to six layers to achieve the desired damping effect.

To reduce noise emissions, U.S. Pat. No. 6,009,856 A also proposes to surround the fuel injector using a sleeve and to fill the created gap with an elastic noise-absorbing material. However, this type of noise damping is very complex, difficult to install and expensive.

SUMMARY

The decoupling element according to the present invention for a fuel injection device may have the advantage that a solid-state joint is designed with a very simple structure and thus improved noise damping is achieved. According to the present invention, the decoupling element has a nonlinear progressive spring characteristic, which results in several positive and advantageous aspects when the decoupling element is installed in a fuel injection device having injectors for direct fuel injection. The low stiffness of the decoupling element at the idling point permits effective decoupling of the fuel injector from the cylinder head and thereby significantly reduces the noise emanating from the cylinder head in the noise-critical idling mode. The great stiffness at a nominal system pressure ensures little movement of the fuel injector on the whole during operation of the vehicle, which thereby, on the one hand, ensures the durability of the sealing rings which function as a combustion chamber seal and as a seal with respect to the fuel rail and, on the other hand, a stable spray point of the fuel spray in the combustion chamber, which is decisive for the stability of some combustion methods.

It may be advantageous in particular to provide one or multiple horizontal or vertical microslots, which facilitate a targeted design of the spring characteristic.

In the case of a multipart decoupling element, it may be advantageous to provide a spacer washer as a separate component, which then forms the supporting base, with yet another component, a stepped ring washer being provided beneath the spacer washer as part of the supporting base. The spacer washer facilitates the adjustment of the increase in stiffness of the decoupling element since the size of the supporting base is adjusted via its thickness (height) and radial extent, and at the same time, the size of the annular gap formed between the first upper component and the spacer washer is also adjusted via the thickness (height).

BRIEF DESCRIPTION OF THE DRAWINGS

Exemplary embodiments of the present invention are shown in simplified form in the figures and are explained in greater detail below.

DETAILED DESCRIPTION OF EXAMPLE EMBODIMENTS

Figure 1:
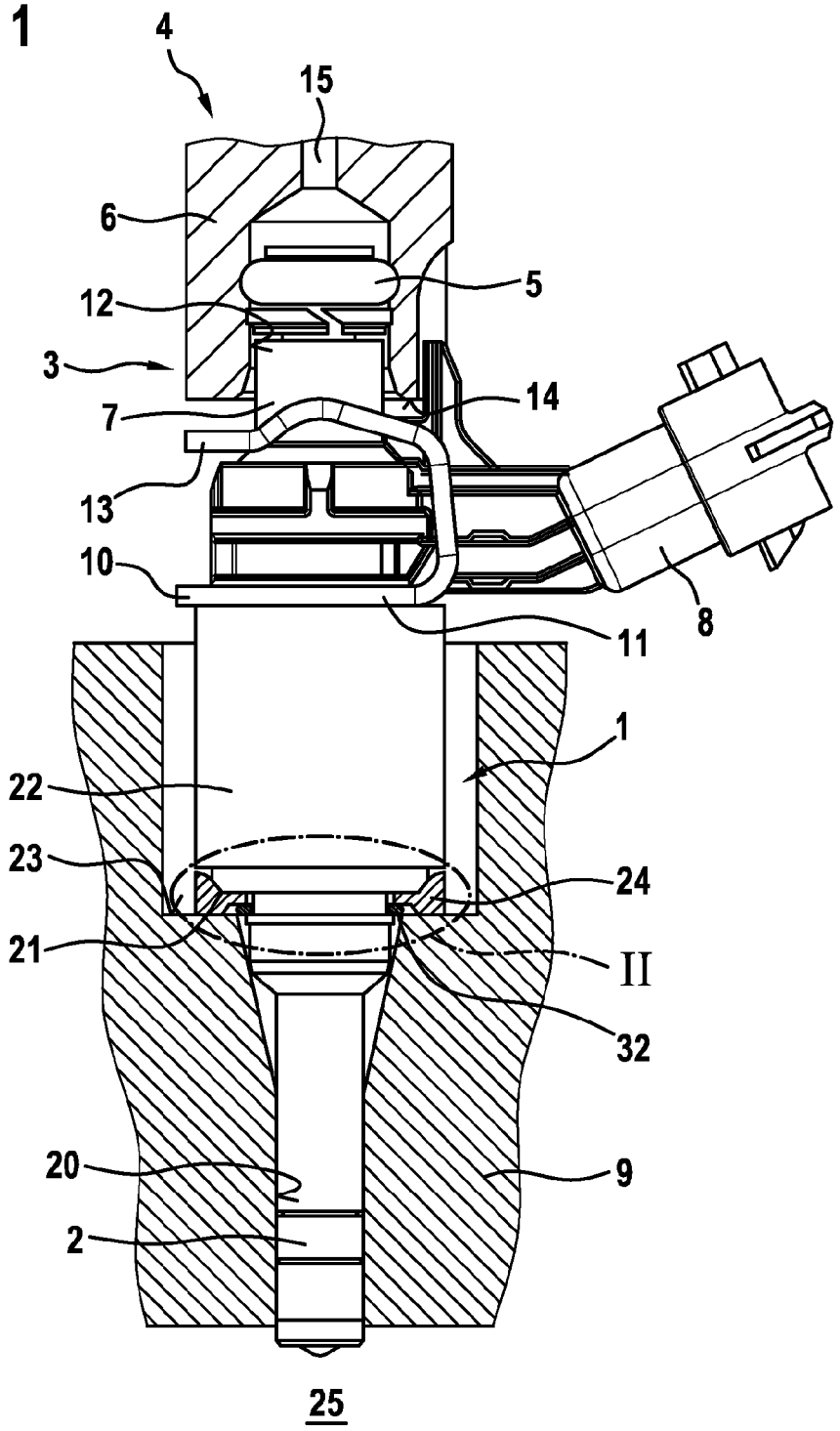
FIG. 1 shows a partial view of a fuel injection device having a decoupling element designed as a solid-state joint.

For an understanding of the present invention, an installation situation of decoupling element 24 according to an example embodiment of the present invention in a fuel injection device is described in greater detail below on the basis of FIG. 1. FIG. 1 illustrates as an exemplary embodiment a valve in the form of an injector 1 for fuel injector systems of mixture-compressing, spark-ignition internal combustion engines in a side view. Fuel injector 1 is part of the fuel injection device. At a downstream end, fuel injector 1, which is designed in the form of a directly injecting injector for direct injection of fuel into a combustion chamber 25 of an internal combustion engine, is installed in a receiving bore 20 of a cylinder head 9. A sealing ring 2 made of Teflon® in particular ensures an optimal seal of fuel injector 1 with respect to the wall of receiving bore 20 of cylinder head 9.

Decoupling element 24 according to the present invention is inserted as a solid-state joint between a shoulder 21 of a valve housing 22 and a shoulder 23 of receiving bore 20 running at a right angle, for example, to the longitudinal extent of receiving bore 20. On its inlet end 3, fuel injector 1 has a plug connection to a fuel distributor line (fuel rail) 4, which is sealed with the aid of a sealing ring 5 between a connecting piece 6 of fuel distributor line 4, shown in a sectional view, and an inlet connection 7 of fuel injector 1. Fuel injector 1 is inserted into a receiving opening 12 of connecting piece 6 of fuel distributor line 4. Connecting piece 6 comes out of actual distributor line 4 in one piece and has a flow opening 15, which has a smaller diameter upstream from receiving opening 12, so that the oncoming flow of fuel injector 1 passes through this smaller flow opening. Fuel injector 1 has an electrical connecting plug 8 for electrical contacting for actuation of fuel injector 1.

A hold-down device 10 is provided between fuel injector 1 and connecting piece 6 to keep fuel injector 1 and fuel distributor line 4 apart from one another, so they are largely free of radial forces and to securely hold down fuel injector 1 in the receiving bore of the cylinder head. Hold-down device 10 is designed as a bow-shaped component, for example, as a punched and bent part. Hold-down device 10 has a partially ring-shaped basic element 11 from which a hold-down clamp 13 runs with a bend, coming in contact with fuel distributor line 4 in the installed state at a downstream end face 14 of connecting piece 6.

One object of the present invention is to achieve improved noise damping, in particular in the noise-critical idling mode in a simple manner through a targeted design and geometry of decoupling element 24. The forces (structure-borne noise) introduced into cylinder head 9 during valve operation are the main source of noise from fuel injector 1 in direct high-pressure injection, resulting in structural excitation of cylinder head 9 and being emanated as airborne noise. To improve the situation, minimization of the forces introduced into cylinder head 9 is therefore to be desired. In addition to a reduction in the forces caused by the injection, this may be achieved by influencing the transmission behavior between fuel injector 1 and cylinder head 9.

In a mechanical sense, the bearing of fuel injector 1 on decoupling element 24 in receiving bore 20 of cylinder head 9 may be thought of as an ordinary spring-mass-damper system. The mass of cylinder head 9 may be assumed to be infinitely large in first approximation in comparison with the mass of fuel injector 1. The transmission behavior of such a system is characterized by amplification at low frequencies in the range of resonant frequency $f_R$ and an isolation range above decoupling frequency $f_E$.

One object of the present invention is to provide a decoupling element 24 with prior use of elastic isolation (decoupling) for noise reduction, in particular in idling mode of the vehicle. The present invention includes, on the one hand, the definition and interpretation of a suitable spring characteristic, taking into account the typical requirements and boundary conditions in direct fuel injection having a variable operating pressure, and on the other hand, the design of a decoupling element 24 capable of mapping the characteristic of the spring characteristic defined in this way and adapted to the specific boundary conditions of the injection system by choosing simple geometry parameters.

To be able to implement the nonlinear spring characteristic in a simple and inexpensive manner under the typical boundary conditions of direct fuel injection (small installation space, high forces, low total movement of fuel injector 1), decoupling element 24 is designed according to the present invention as a solid-state joint which has a bearing collar 28 including a valve contact surface 29 designed to be spherical, i.e., convex, which extends upward from a flat annular area 30. Flat annular area 30 is in turn based on a supporting base 31 of a smaller width. Flat annular area 30 of decoupling element 24 may optionally also be supported on a ring of a small cross-sectional diameter, for example, on a snap ring 32, which is in contact with a valve shoulder at its inside edge.

Figure 2:
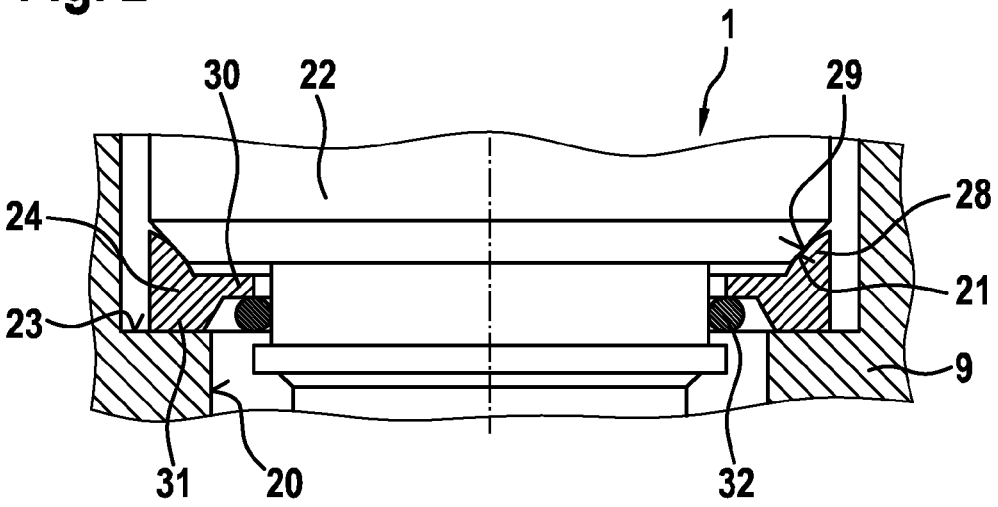
FIG. 2 shows detail II of FIG. 1 in an enlarged diagram having a bearing collar covering 360° of a one-piece decoupling element according to an example embodiment of the present invention.

FIG. 2 shows detail II of FIG. 1 around decoupling element 24 in an enlarged diagram, showing a bearing collar 28 covering 360° of a one-piece decoupling element 24 according to the present invention. For example, decoupling element 24 has an outside diameter here which corresponds to that of valve housing 22 above decoupling element 24. On its outside diameter, decoupling element 24 has a cylindrical lateral surface. Toward the inside, decoupling element 24 has a structure according to the present invention. On the basis of the figures shown below, this example design according to the present invention will now be discussed in greater detail.

Figure 3:
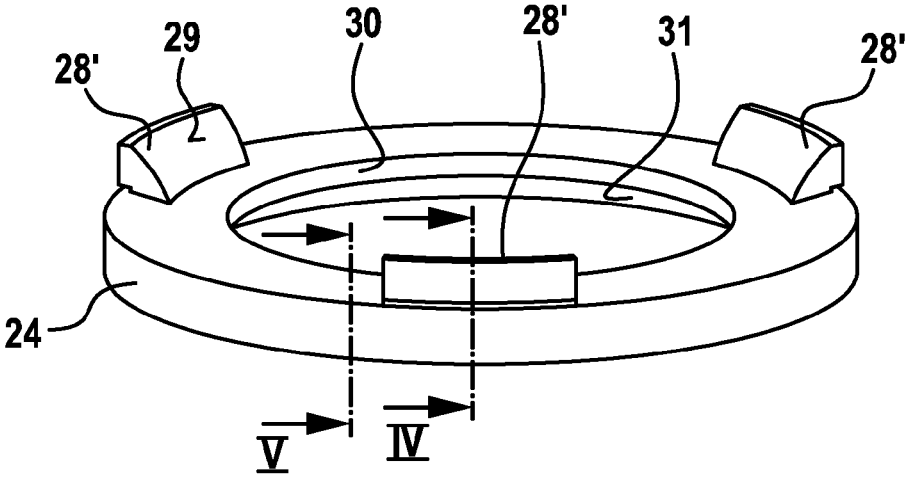
FIG. 3 shows an alternative embodiment of a decoupling element having three bearing collar sections.

FIG. 3 illustrates an alternative embodiment of a decoupling element 24, in which three bearing collar sections 28' which are equally distributed over the circumference are formed instead of the peripheral bearing collar 28. These bearing collar sections 28' have only a peripheral extent corresponding to approximately 15° to 45°. In addition to the approach shown here having three bearing collar sections 28', those having four, five, six or more bearing collar sections 28' are also possible.

Figure 4:
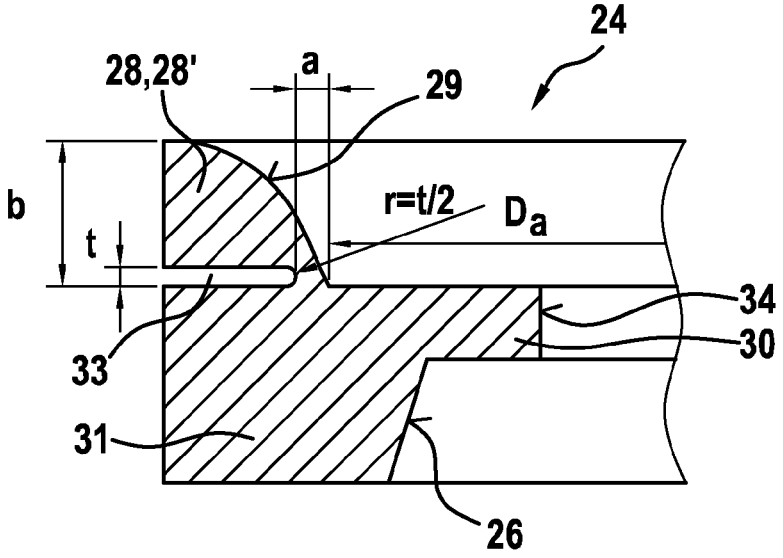
FIG. 4 shows a cross section through the decoupling element along line IV-IV in FIG. 3.
Figure 5:
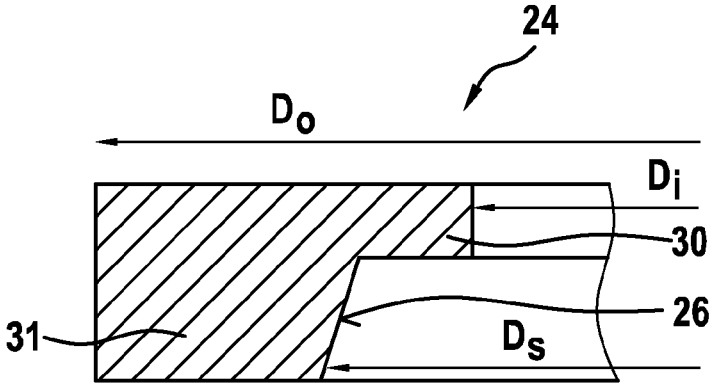
FIG. 5 shows a cross section through the decoupling element along line V-V in FIG. 3.

FIG. 4 shows a cross section through decoupling element 24 along line IV-IV in FIG. 3, while FIG. 5 shows a cross section through decoupling element 24 along line V-V in FIG. 3. The cross section through decoupling element 24 according to FIG. 4 is also transferable to an embodiment having a completely peripheral bearing collar 28. It is apparent from FIG. 4 that horizontal microslots 33 may be introduced, for example, in the area of bearing collar sections 28', for a targeted design of the spring characteristic. Similarly, in the case of a completely peripheral bearing collar 28, a peripheral microslot 33 may be provided, but a plurality of microslots 33 distributed around the circumference is also possible. FIG. 4 shows the contours and dimensional relationships of example coupling element 24 according to the present invention in great detail, but it should be emphasized that the size of microslot 33 is not drawn to scale, but instead has been greatly exaggerated. Bearing collar 28 and bearing collar sections 28' are provided with a valve contact surface 29, which is spherical, i.e., convex, corresponding to a conical valve housing surface 21 in the installed state of decoupling element 24, so that there is only linear contact of the corresponding component partners 1, 24 in idealized form here, which is even further minimized in an embodiment having multiple short bearing collar sections 28'. Bearing collar 28 extends upward from flat annular area 30, which protrudes inward and has its smallest inside diameter $D_i$ on its inside 34. Flat annular area 30 protrudes out of supporting base 31, which has a smaller width, inside 26 of supporting base 31 being conical, thereby making inside diameter $D_s$ of supporting base 31 variable over its height, and having its largest inside diameter $D_s$ on the lower edge of decoupling element 24, where supporting base 31 thus has the smallest material thickness.

The following dimensions are given for an understanding of the present invention but should in no way restrict it; these may be preferred for a decoupling element 24 according to the present invention:

- largest inside diameter $D_s$ at the lower edge of supporting base 31 approximately 17 mm,
- inside diameter $D_i$ of flat annular area 30 approximately 14 mm,
- inside diameter $D_a$ of bearing collar 28 at transition to annular area 30 approximately 18 mm,
- outside diameter $D_o$ of decoupling element 24 approximately 21 mm,
- height b of bearing collar 28 approximately 1.25 mm,
- height t of a microslot 33 approximately 0.03 mm-0.06 mm,
- minimum distance "a" from the end of microslot 33 to valve contact surface 29 in bearing collar 28 approximately 0.3 mm-0.5 mm.

The insertion of microslots 33 into bearing collar 28 may be accomplished, for example, by wire erosion, laser drilling, laser cutting. Decoupling element 24 itself may be manufactured with the aid of MIM (metal injection molding) technology or traditionally as a turned part, including shaping/bending.

Figure 6:
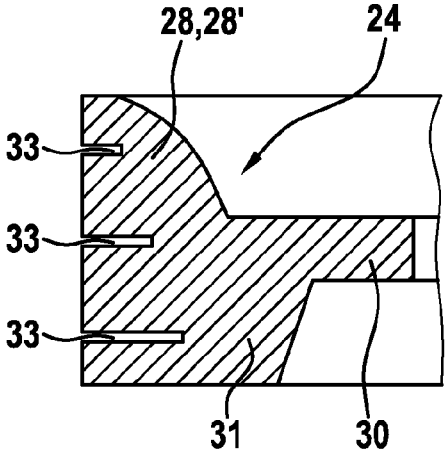
FIG. 6 shows a second alternative embodiment of a decoupling element in cross section similar to the diagram according to FIG. 4.

FIG. 6 shows a second alternative embodiment of a decoupling element 24 in cross section, as in the diagram according to FIG. 4, into which horizontal microslots 33 of various lengths are introduced in three planes, the longest microslot 33 being provided in supporting base 31, for example.

Figure 7:
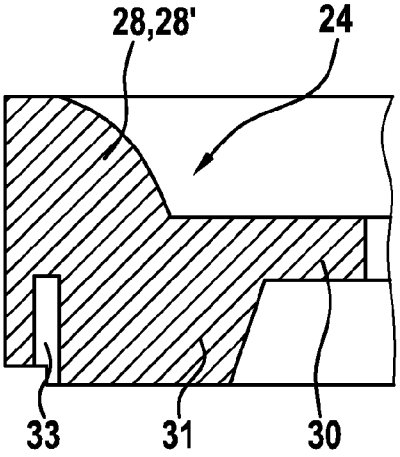
FIG. 7 shows a third alternative embodiment of a decoupling element in cross section similar to the diagram according to FIG. 4.

FIG. 7 shows a third alternative embodiment of a decoupling element 24 in cross section, as in the diagram according to FIG. 4, into which a vertical microslot 33 is introduced, extending from the lower edge of decoupling element 24 to the height of annular area 30 close to outside diameter $D_o$ of decoupling element 24.

Figure 8:
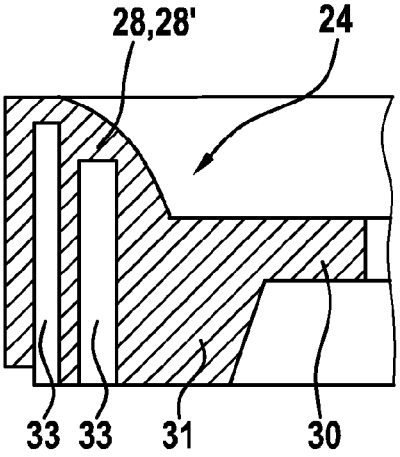
FIG. 8 shows a fourth alternative embodiment of a decoupling element in cross section similar to the diagram according to FIG. 4.

FIG. 8 shows a fourth alternative embodiment of a decoupling element 24 in cross section, as in the diagram according to FIG. 4, into which multiple vertical microslots 33 are introduced, extending from the lower edge of decoupling element 24 into the area of bearing collar 28, 28' and are designed of different widths and lengths. Vertical microslots 33 have widths up to 0.3 mm, for example.

Structuring of microslots 33 in some other way than that illustrated in the exemplary embodiments in FIGS. 6, 7 and 8 is certainly also possible.

Figure 9:
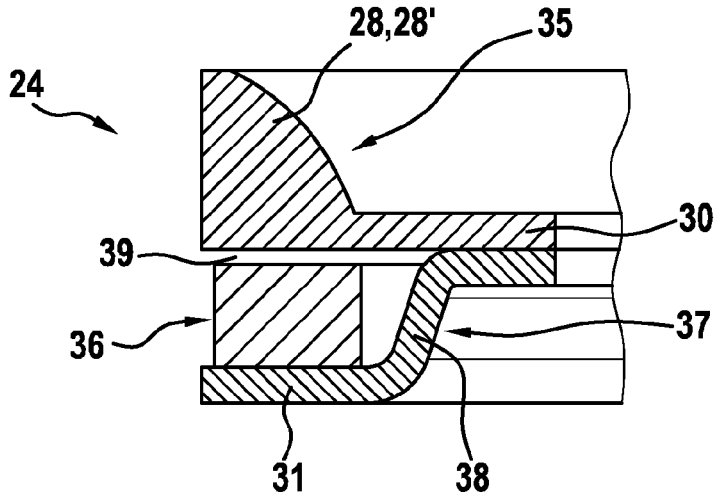
FIG. 9 shows an additional embodiment of a decoupling element according to the present invention in a multipart approach.

FIG. 9 shows another embodiment of a decoupling element 24 according to the present invention, which has a multi-part design in the present case. A first component 35 forms bearing collar 28, 28' and a first portion of flat annular area 30, while a second component 36 designed as a spacer washer forms supporting base 31, and a third component 37 as a stepped ring washer forms a second portion of flat annular area 30 and, extending beneath spacer washer 36, also forms a part of supporting base 31. Stepped ring washer 37 has a central conical area 38, with which the thickness of spacer washer 36 may be bridged and which in its contouring is based on conical inside 26 of supporting base 31 according to FIGS. 4 and 5. Spacer washer 36 facilitates adjustment of the increase in stiffness of decoupling element 24 since the size of supporting base 31 is adjusted via its thickness (height) and radial extent and at the same time the size of annular gap 39 formed between first component 35 and spacer washer 36 is also adjusted via the thickness (height).

Individual components 35, 36, 37, which together form decoupling element 24, are fixedly attached to one another in a loss-proof manner by spot welds or weld seams, for example.

Figure 10:
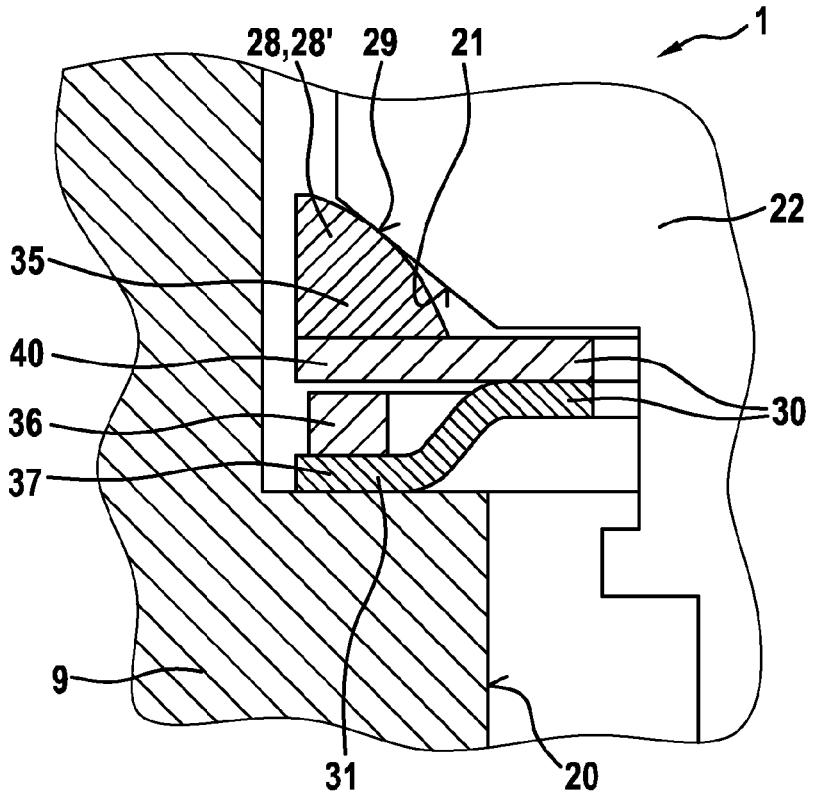
FIG. 10 shows a second embodiment of a decoupling element according to the present invention in a multipart approach.

FIG. 10 shows again an installation situation for a second embodiment of a decoupling element 24 according to the present invention in a multi-part approach which includes four components 35, 36, 37, 40. Decoupling element 24 differs from decoupling element 24 described in conjunction with FIG. 9 in particular in that bearing collar 28, 28' is designed as a ring collar, which is compact per se, and flat annular area 30 is formed with the aid of a thin washer 40, which extends to the outside diameter of decoupling element 24 and extends insofar beneath bearing collar 28, 28'. Furthermore, FIG. 10 illustrates that decoupling element 24 need not necessarily be flush with valve housing 22 radially on the outside but instead, as shown here, for example, may also protrude outward, depending on the use requirements. A setback variant is not shown but is also included.

Individual components 35, 36, 37, 40, which together form decoupling element 24, are fixedly joined to one another in a loss-proof manner via spot welds or weld seams, for example.

What is claimed is:

1. A decoupling element for a fuel injection device for a fuel injection system of an internal combustion engine, the fuel injection device including at least one fuel injector and one receiving bore for the fuel injector, and the decoupling element being situated between a valve housing of the fuel injector and a wall of the receiving bore, wherein the decoupling element is a solid-state joint which has a nonlinear progressive spring characteristic line, at least one bearing collar including a valve contact surface designed to be convex, extending upward out of a flat annular area, the flat annular area being supported on a supporting base, extending downwards out of the flat annular area, and an inside of the flat annular area having a inside diameter that is smaller than both an inside diameter of the bearing collar and an inside diameter of the supporting base supported on the wall of the receiving bore.

2. The decoupling element as recited in claim 1, wherein the decoupling element has a one-piece or a multi-piece design.

3. The decoupling element as recited in claim 1, wherein the decoupling element has at least one horizontal or vertical microslot, the microslot starting from an outer lateral surface or lower edge of the decoupling element.

4. The decoupling element as recited in claim 1, wherein the bearing collar is formed with the aid of at least three bearing collar sections, each having a circumferential extent of 15° to 45°.

5. The decoupling element as recited in claim 3, wherein the bearing collar is designed to be peripheral.

6. The decoupling element as recited in claim 3, wherein the microslots have widths between 0.03 mm and 0.3 mm.

7. The decoupling element as recited in claim 1, wherein one inside of the supporting base runs conically, so that the supporting base has a largest inside diameter at lower edge of the decoupling element.

8. The decoupling element as recited in claim 1, wherein the decoupling element is made up of three or four components fixedly connected to one another.

9. The decoupling element as recited in claim 8, wherein the at least one bearing collar is formed on a first component, while a stepped ring washer as the third component extends beneath a spacer washer as the second component.

10. The decoupling element as recited in claim 9, wherein the spacer washer facilitates the adjustment of the increase in stiffness of the decoupling element since a size of the supporting base is adjusted via a thickness and radial extent of the washer, and at the same time a size of an annular gap formed between the first component and the spacer washer is also adjusted via the thickness.

11. The decoupling element as recited in claim 1, wherein the receiving bore for the fuel injector in a cylinder head, and the receiving bore has a shoulder running perpendicularly to the extent of the receiving bore, and the supporting base of the decoupling element rests on the shoulder.

* * * * *